US007306303B2

(12) United States Patent
Ritchie et al.

(10) Patent No.: US 7,306,303 B2
(45) Date of Patent: Dec. 11, 2007

(54) METHODS AND APPARATUS FOR REFRIGERATOR COMPARTMENT

(75) Inventors: Sheena Leigh Ritchie, Louisville, KY (US); Martin Mitchell Zentner, Prospect, KY (US); Carolyn Lilley McIntyre, Chicago, IL (US)

(73) Assignee: General Electric Company, Schenectady, NY (US)

( * ) Notice: Subject to any disclaimer, the term of this patent is extended or adjusted under 35 U.S.C. 154(b) by 301 days.

(21) Appl. No.: 10/609,747

(22) Filed: Jun. 30, 2003

(65) Prior Publication Data

US 2004/0263037 A1 Dec. 30, 2004

(51) Int. Cl.
*A47B 96/02* (2006.01)

(52) U.S. Cl. ..... 312/408; 248/244

(58) Field of Classification Search ..... 312/401, 312/405.1, 408, 410, 306, 312, 319.5, 319.7; 62/382, 440; 248/241, 243, 244; 211/90.01, 211/90.02, 187
See application file for complete search history.

(56) References Cited

U.S. PATENT DOCUMENTS 1,116,091 A * 11/1914 McDonald ..... 248/244
2,836,305 A * 5/1958 Davey et al. ..... 108/138
2,841,459 A * 7/1958 Sharpe ..... 312/306
3,337,283 A * 8/1967 Schlenkert ..... 312/306
3,360,322 A * 12/1967 Hanifan ..... 312/312
3,361,510 A * 1/1968 McDermott ..... 312/312
3,982,801 A * 9/1976 Heidorn et al. ..... 312/306
4,819,900 A * 4/1989 Funk ..... 248/244
4,881,471 A * 11/1989 Schwartz et al. ..... 108/147
5,199,778 A 4/1993 Aoki et al.
5,842,585 A 12/1998 Hollander
5,913,584 A 6/1999 Swindell et al.
6,065,821 A 5/2000 Anderson et al.
6,224,127 B1 * 5/2001 Hodge ..... 296/26.08

* cited by examiner

*Primary Examiner*—James O. Hansen
(74) *Attorney, Agent, or Firm*—George L. Rideout, Esq.; Armstrong Teasdale LLP

(57) ABSTRACT

A shelf assembly is provided. The shelf assembly includes a plate having a shaft flange extending substantially perpendicular therefrom, and a shaft mounted to the shaft flange. The shaft extends from the shaft flange along a first axis. The shelf assembly further includes a shelf slidably mounted to the shaft such that the shelf is movable on the shaft along the first axis.

12 Claims, 6 Drawing Sheets

METHODS AND APPARATUS FOR REFRIGERATOR COMPARTMENT

BACKGROUND OF THE INVENTION

This invention relates generally to refrigerators, and more particularly, to control systems for refrigerator compartments.

Some known refrigerators include a fresh food compartment and a freezer compartment. Such a refrigerator also typically includes a refrigeration sealed system circuit including a compressor, an evaporator, and a condenser connected in series. An evaporator fan is provided to blow air over the evaporator, and a condenser fan is provided to blow air over the condenser. In operation, when an upper temperature limit is reached in the freezer compartment, the compressor, evaporator fan, and condenser fan are energized. Once the temperature in the freezer compartment reaches a lower temperature limit, the compressor, evaporator fan, and condenser fan are de-energized.

A typical refrigeration apparatus, such as a refrigerator/freezer, includes one or more refrigerated compartments. A plurality of storage systems, such as shelves and/or pans, are mounted within the compartments for storing items to be refrigerated. The storage systems can be stationary or selectively positionable within the compartments. Commonly, shelves are cantilevered from tracks mounted at the rear of the compartment so that they can be moved between a fixed number of predetermined vertical positions along the tracks.

The spacing above each shelf must be sufficient to allow items of various sizes to be placed thereon without interference. Occasionally, therefore, the shelves are repositioned to a different height. When the shelves are cantilevered from the tracks, however, all of the items must be removed from the shelf before the shelf can be removed from the track and repositioned to a new position. Additionally, the shelves can only be located at a fixed number predetermined positions. The predetermined positions of the shelves, therefore, may not allow optimal usage of the storage space within the compartment.

BRIEF DESCRIPTION OF THE INVENTION

In one aspect, a shelf assembly is provided. The shelf assembly includes a plate having a shaft flange extending substantially perpendicular therefrom, and a shaft mounted to the shaft flange. The shaft extends from the shaft flange along a first axis. The shelf assembly further includes a shelf slidably mounted to the shaft such that the shelf is movable on the shaft along the first axis.

In another aspect, a shelf assembly includes a plate having a pair of opposed shaft flanges extending substantially perpendicular from the plate, a shaft rotatably mounted between the pair of opposed shaft flanges, the shaft rotatable about a first axis, a nut having a nut opening for the shaft to extend therethrough, the shaft is in threaded relationship with the nut opening, and a shelf mounted to the nut, the shelf movable on the shaft along the first axis when the shaft is rotated about the first axis.

In a further aspect, a refrigerator is provided. The refrigerator includes a fresh food compartment, a freezer compartment, and a shelf assembly mounted in at least one of said fresh food compartment and freezer compartment. The shelf assembly includes a plate having a shaft flange extending substantially perpendicular therefrom, and a shaft mounted to the shaft flange. The shaft extends from the shaft flange along a first axis. The shelf assembly further includes a shelf slidably mounted to the shaft. The shelf is movable along the shaft.

DETAILED DESCRIPTION OF THE INVENTION

Figure 1:
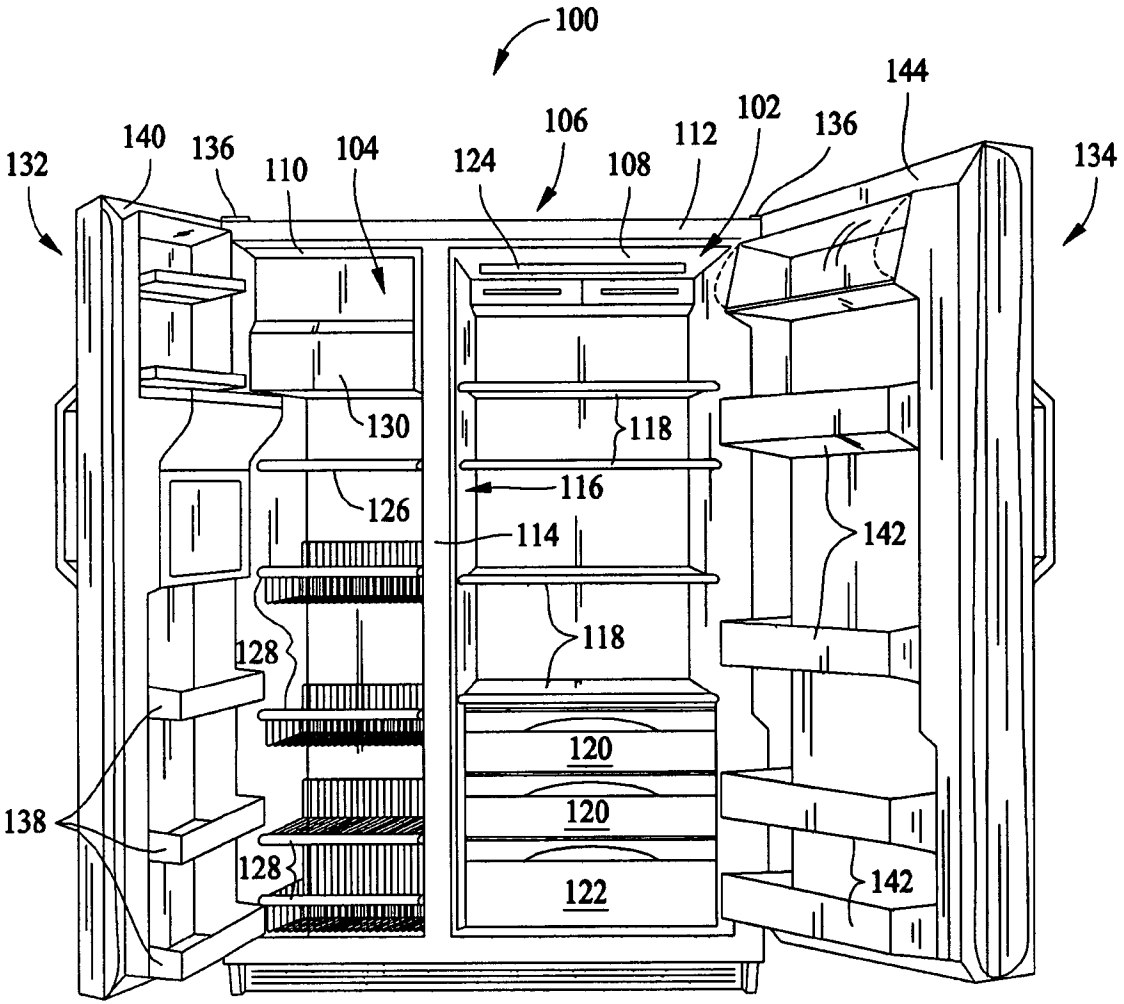
FIG. 1 is a perspective view of a refrigerator.

FIG. 1 illustrates a side-by-side refrigerator 100 including a fresh food storage compartment 102 and freezer storage compartment 104. Freezer compartment 104 and fresh food compartment 102 are arranged side-by-side. In one embodiment, refrigerator 100 is a commercially available refrigerator from General Electric Company, Appliance Park, Louisville, Ky. 40225, and is modified to incorporate the herein described methods and apparatus.

It is contemplated, however, that the teaching of the description set forth below is applicable to other types of refrigeration appliances, including but not limited to top and bottom mount refrigerators. The present invention is therefore not intended to be limited to any particular type or configuration of a refrigerator, such as refrigerator 100.

Refrigerator 100 includes a fresh food storage compartment 102 and a freezer storage compartment 104 contained within an outer case 106 and inner liners 108 and 110. A space between case 106 and liners 108 and 110, and between liners 108 and 110, is filled with foamed-in-place insulation. Outer case 106 normally is formed by folding a sheet of a suitable material, such as pre-painted steel, into an inverted U-shape to form top and side walls of case. A bottom wall of case 106 normally is formed separately and attached to the case side walls and to a bottom frame that provides support for refrigerator 100. Inner liners 108 and 110 are molded from a suitable plastic material to form freezer compartment 104 and fresh food compartment 102, respectively. Alternatively, liners 108, 110 may be formed by bending and welding a sheet of a suitable metal, such as steel. The illustrative embodiment includes two separate liners 108, 110 as it is a relatively large capacity unit and separate liners add strength and are easier to maintain within manufacturing tolerances. In smaller refrigerators, a single liner is formed and a mullion spans between opposite sides of the liner to divide it into a freezer compartment and a fresh food compartment.

A breaker strip 112 extends between a case front flange and outer front edges of liners. Breaker strip 112 is formed from a suitable resilient material, such as an extruded acrylo-butadiene-styrene based material (commonly referred to as ABS).

The insulation in the space between liners 108, 110 is covered by another strip of suitable resilient material, which also commonly is referred to as a mullion 114. Mullion 114 also preferably is formed of an extruded ABS material. Breaker strip 112 and mullion 114 form a front face, and extend completely around inner peripheral edges of case 106 and vertically between liners 108, 110. Mullion 114, insulation between compartments, and a spaced wall of liners separating compartments, sometimes are collectively referred to herein as a center mullion wall 116.

Shelves 118 and slide-out drawers 120 normally are provided in fresh food compartment 102 to support items being stored therein. A bottom drawer or pan 122 partly forms a quick chill and thaw system (not shown) and selectively controlled, together with other refrigerator features, by a microprocessor (not shown in FIG. 1) according to user preference via manipulation of a control interface 124 mounted in an upper region of fresh food storage compartment 102 and coupled to the microprocessor. A shelf 126 and wire baskets 128 are also provided in freezer compartment 104. In addition, an ice maker 130 may be provided in freezer compartment 104.

A freezer door 132 and a fresh food door 134 close access openings to fresh food and freezer compartments 102, 104, respectively. Each door 132, 134 is mounted by a top hinge 136 and a bottom hinge (not shown) to rotate about its outer vertical edge between an open position, as shown in FIG. 1, and a closed position (not shown) closing the associated storage compartment. Freezer door 132 includes a plurality of storage shelves 138 and a sealing gasket 140, and fresh food door 134 also includes a plurality of storage shelves 142 and a sealing gasket 144.

In accordance with known refrigerators, refrigerator 100 also includes a machinery compartment (not shown) that at least partially contains components for executing a known vapor compression cycle for cooling air. The components include a compressor (not shown in FIG. 1), a condenser (not shown in FIG. 1), an expansion device (not shown in FIG. 1), and an evaporator (not shown in FIG. 1) connected in series and charged with a refrigerant. The evaporator is a type of heat exchanger which transfers heat from air passing over the evaporator to a refrigerant flowing through the evaporator, thereby causing the refrigerant to vaporize. The cooled air is used to refrigerate one or more refrigerator or freezer compartments via fans (not shown in FIG. 1). Collectively, the vapor compression cycle components in a refrigeration circuit, associated fans, and associated compartments are referred to herein as a sealed system. The construction of the sealed system is well known and therefore not described in detail herein, and the sealed system is operable to force cold air through the refrigerator subject to the following control scheme.

Figure 2:
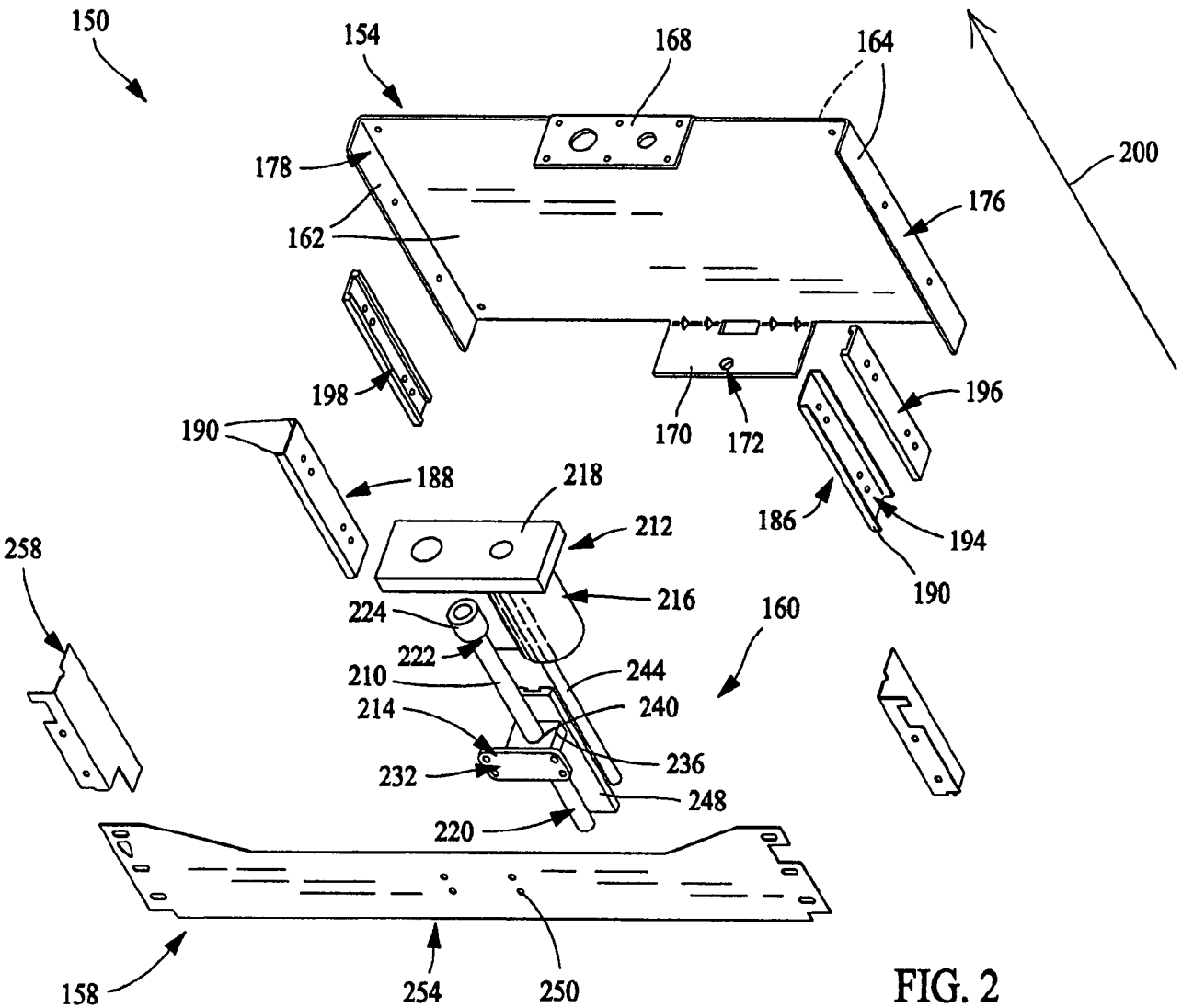
FIG. 2 is an exploded view of a shelf assembly.

FIG. 2 is an exploded view of a shelf assembly 150 including a plate 154, a moving plate 158, and a shaft assembly 160 disposed therebetween. Shelf assembly 150 is modular and capable of being mounted within either fresh food compartment 102 or freezer food compartment 104 of refrigerator 100. Plate 154 has a inner surface 162 and an outer surface 164. Plate 154 has a pair of opposed shaft flanges 168 and 170. Shaft flanges 168 and 170 extend substantially perpendicular to inner surface 162 of plate 154 and at least one of shaft flanges 168 and 170 has at least one opening 172 therethrough for receiving shaft assembly 160. Plate 154 also includes opposed first support flange 176 and second support flange 178 extending substantially perpendicular to inner surface 162 of plate 154. In one embodiment, at least one of shaft flanges 168 and 170, first support flange 176 and second support flange 178, are integral with plate 154. Thus, first and second support flanges 176 and 178 each have an inner surface 162 and an outer surface 164.

In one embodiment, first and second support flanges 176 and 178 are diametrically opposed to pair of shaft flanges 168 and 170. In one embodiment, outer surface 164 of at least one of first and second support flanges 176 and 178 has a groove extending along the length of the support flange for slidably receiving moving plate 158. In the exemplary embodiment, first support flange 176 has a first plate track 186 mounted to outer surface 164 thereon, such as by a fastener, and second support flange 178 has a second plate track 188 mounted to outer surface 164 thereon. Each of first and second plate tracks 186 and 188 has a pair of side walls 190 forming a groove or channel 194. A first slide member 196 and a second slide member 198 are receivable within first and second plate tracks 186 and 188, respectively. First and second slide members 196 and 198 are slidable within first and second plate tracks 186 and 188, respectively, along a first axis 200.

Shaft assembly 160 includes at least a shaft 210, a motor assembly 212, and a driving nut 214. Shaft 210 is rotatably mounted between pair of opposed shaft flanges 168 and 170 so that shaft 210 is rotatable about first axis 200. Motor assembly 212 includes a motor 216 and a translational means 218, such as a gear box. Motor 216 provides rotational forces, which are imparted to shaft 210 through gear box 218. In one embodiment, gear box 218 has at least a first gear (not shown) and a second gear (not shown). Motor 216 is coupled to first gear and rotates first gear in one direction. In turn, first gear rotates second gear in an opposite direction. In this embodiment, shaft 210 is rotatable fixed between gear box 218 and shaft flange 170. Shaft 210 has one end 220 rotatably mounted to at least one opening 172 in one of shaft flanges 168 and 170, and another end 222 connected to second gear by a coupling 224. In another embodiment, translation means 218 imparts rotational forces from motor 216 to shaft 210 by means other than gears in order to rotate shaft 210 about first axis 200.

Driving nut 214 has a mounting portion 232 and a sliding portion 236. Driving nut 214 further includes an opening 240 therethrough disposed between mounting portion 232 and sliding portion 236. Shaft 210 extends through an opening of driving nut 214. In one embodiment, shaft 210 and the opening of driving nut 214 are in threaded relationship such that rotation of shaft 210 in one direction moves driving nut 214 in one direction along first axis 200. Thus, by rotating shaft 210 in either a clockwise or counter clockwise direction about first axis 200, driving nut 214 is moved in either direction along first axis 200. In one embodiment, a third plate track 244 is mounted on inner surface 162 of plate 154, such as by a fastener. A third sliding member 248 is receivable within third plate track 244. Third sliding member 248 slides within third plate track 244 along first axis 200. Sliding portion 236 of driving nut 214 is mounted to third sliding member 248, such as by a fastener.

Moving plate 158 is mounted to mounting portion 232 of driving nut 214. In one embodiment, moving plate 158 has a plurality of openings 250 in a central region 254 thereof, for mounting moving plate 158 to mounting portion 232 of driving nut 214 by a fastener. In one embodiment, moving plate 158 is mounted to at least one bracket 258, such as by a fastener. At least one bracket 258 is mounted to at least one of first and second sliding members 196 and 198 allowing moving plate 158 to slide in either direction along first axis 200.

Figure 3:
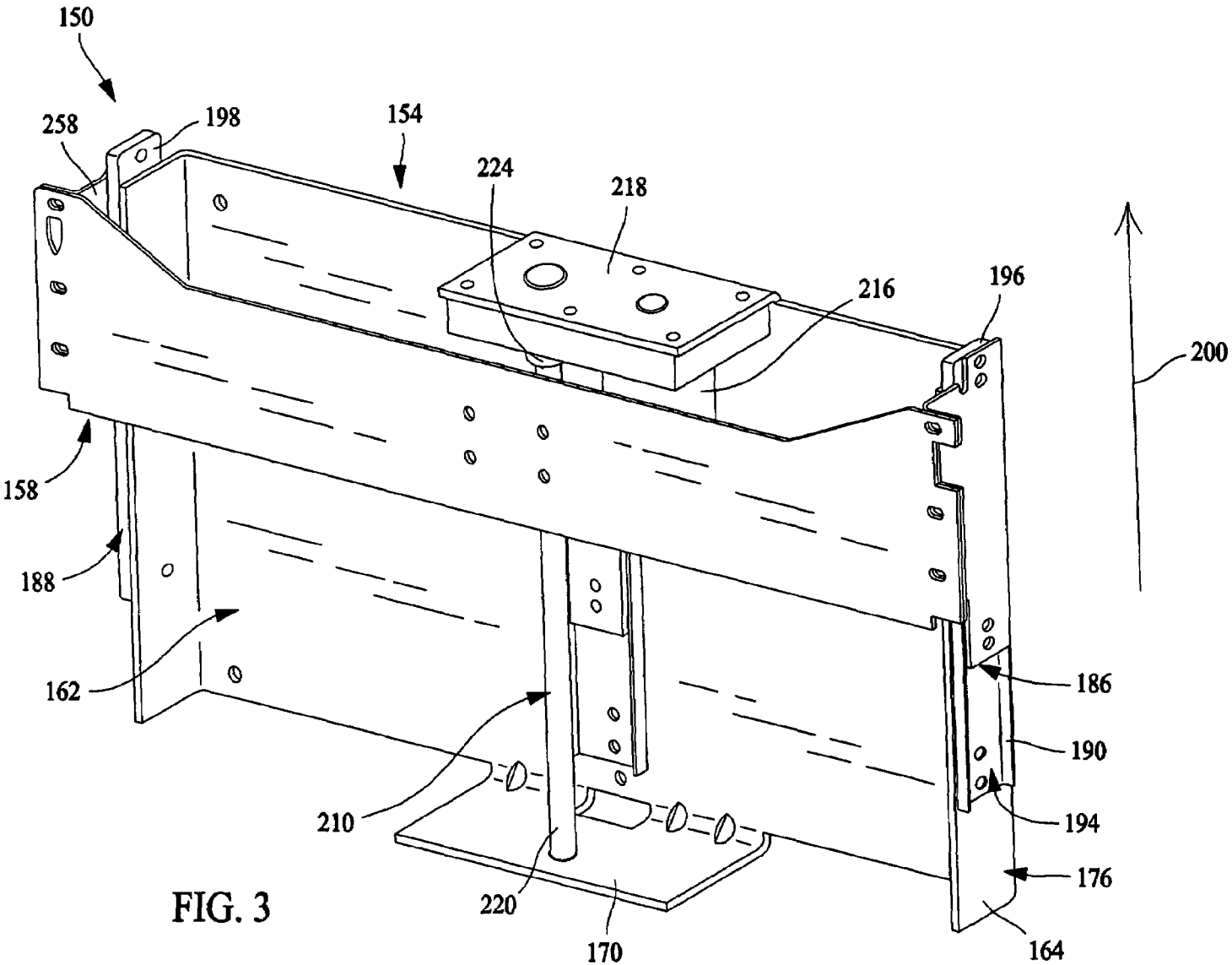
FIG. 3 is a perspective view of the shelf assembly.
Figure 4:
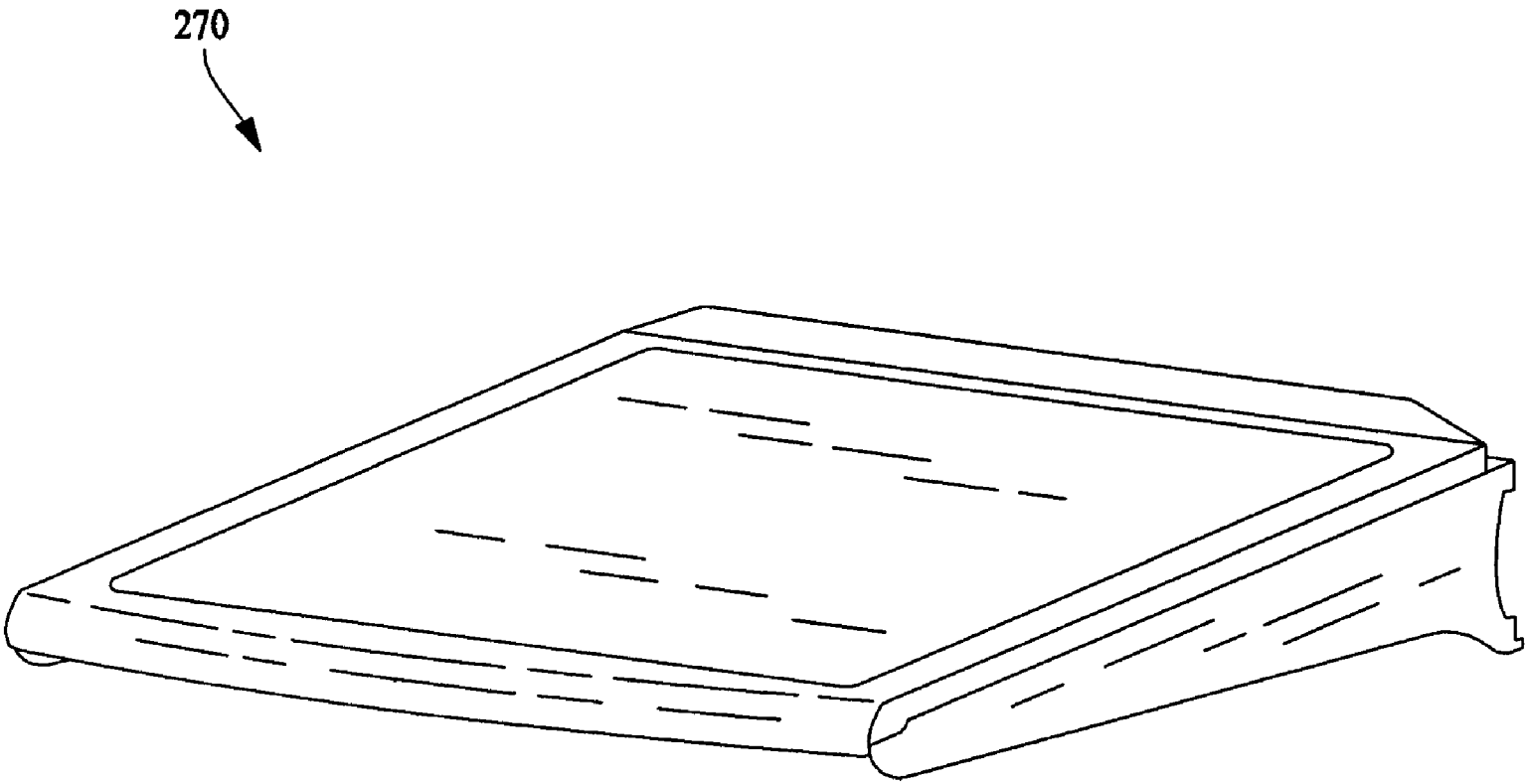
FIG. 4 is a perspective view of a shelf.
Figure 5:
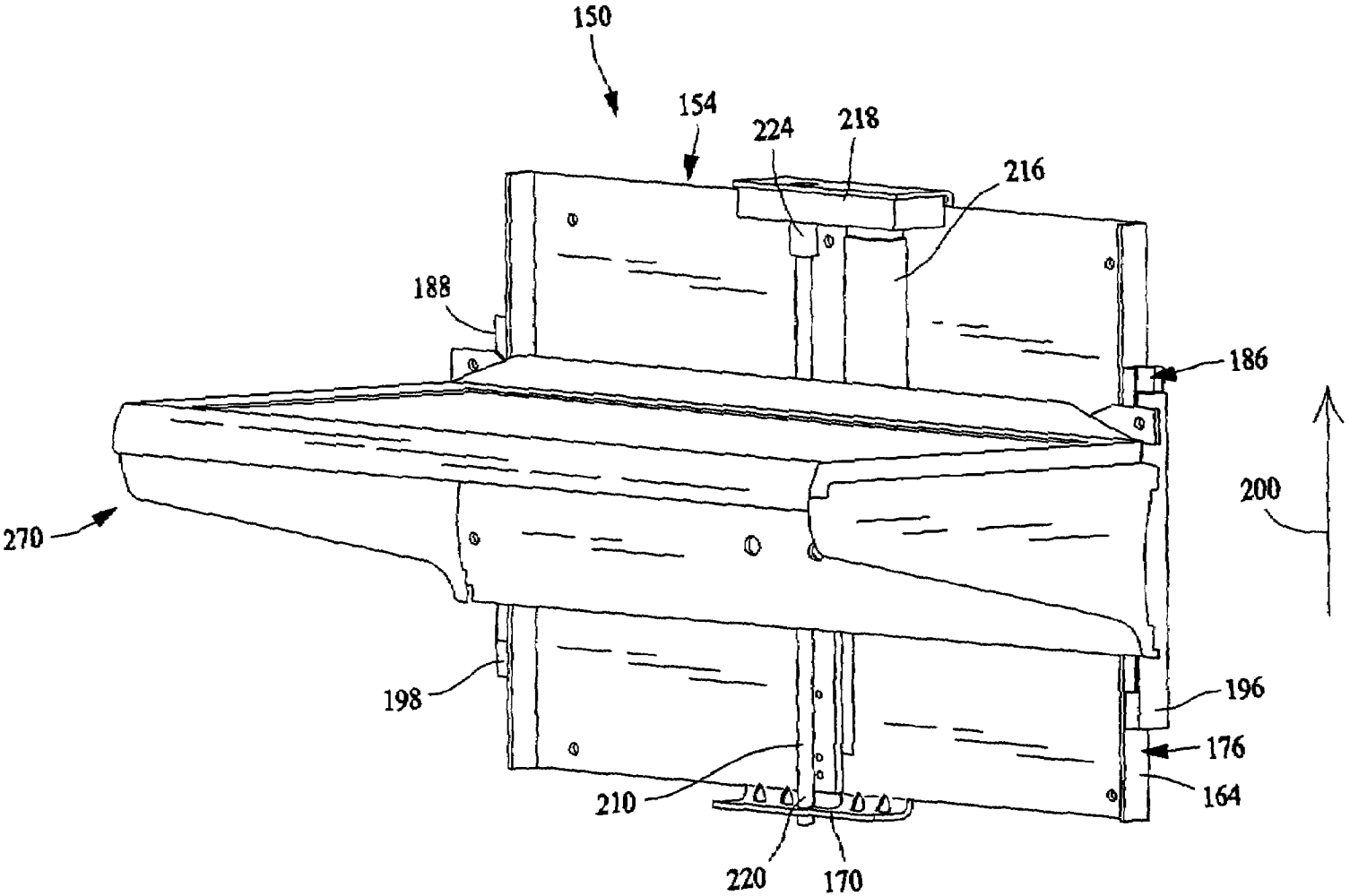
FIG. 5 is a perspective view of the shelf mounted to the shelf assembly.

FIG. 3 is a perspective view of shelf assembly 150. FIG. 4 is a perspective view of a shelf 270. FIG. 5 is a perspective view of shelf 270 of FIG. 4 mounted to shelf assembly 150 of FIG. 3, such as by a fastener. Shelf assembly 150 is mounted to at least one of inner liners 108 and 110 such that outer surface 164 of plate 154 faces at least one of inner liners 108 and 110. Shelf assembly 150 is modular in that it can be pre-assembled and then attached to inner liners 108 and 110 of refrigerator 100.

As motor 216 is energized to drive the rotation of shaft 210 in one direction the threaded relationship between shaft 210 and driving nut 214 causes driving nut 214 to move in one direction along first axis 200. As driving nut 214 moves in one direction along first axis 200, moving plate 158 moves in the same direction along first axis 200. In one embodiment, a user controls the movement of moving plate 158 in a desired direction according to a user input interface. In another embodiment, a user manually operates motor assembly 212 to control the movement of shelf 270. In another embodiment, shaft 210 may be manually rotated in one direction or the other thereby controlling the movement of shelf 270 along first axis 200. In one embodiment, shelf 270 is movable along first axis 200 in the range of 3 to 8 inches. In another embodiment, shelf 270 is designed to move up to three inches along first axis 200. In another embodiment, shelf 270 is designed to move at least 8 inches along first axis 200.

Figure 6:
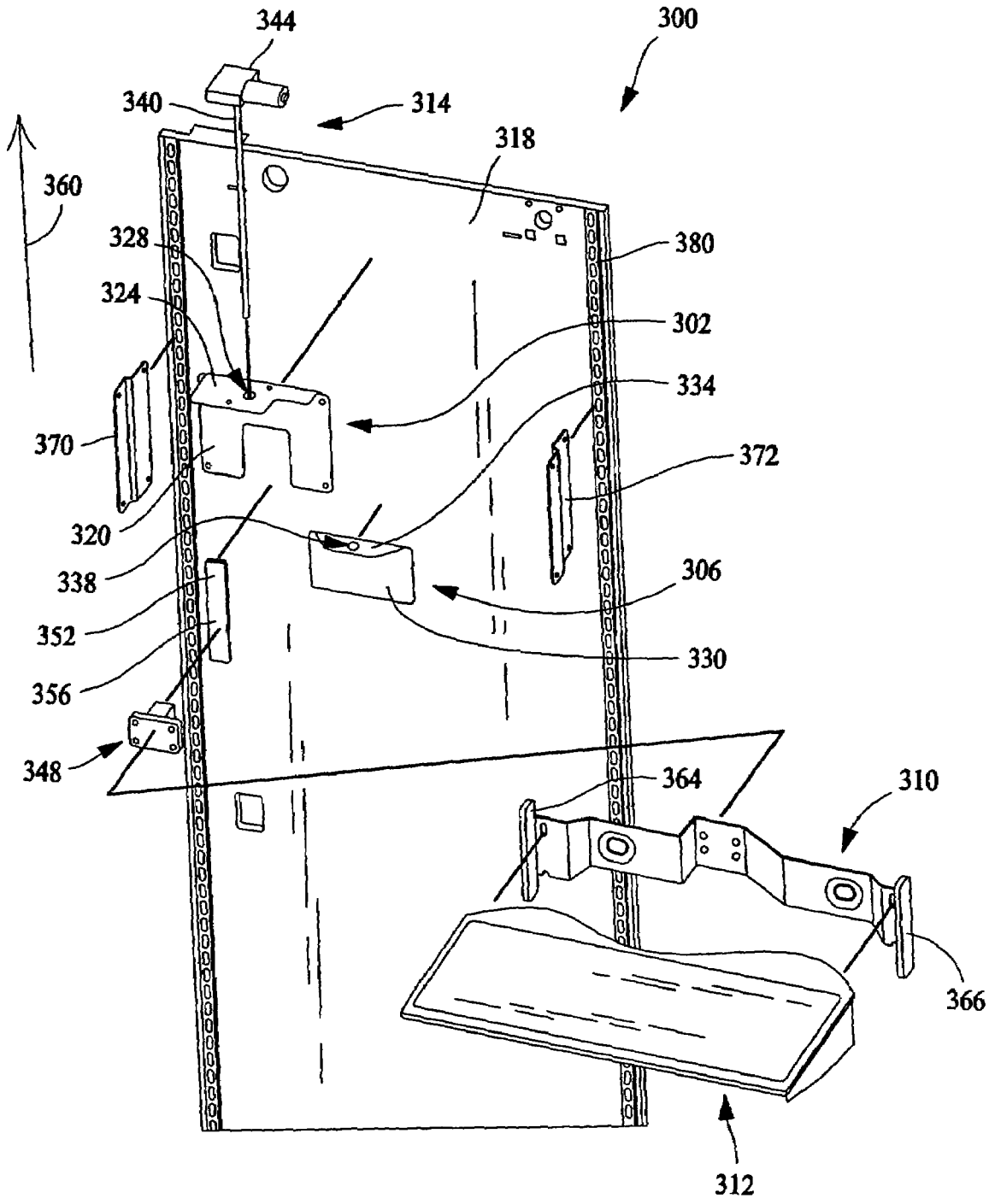
FIG. 6 is an exploded view of an alternative embodiment of a shelf mounted to a shelf assembly.

FIG. 6 is an exploded view of an another embodiment of a shelf assembly 300 including a first plate 302, a second plate 306, a moving plate 310 with a shelf 312 mounted thereto, and a shaft assembly 314. Shelf assembly 300 is modular and capable of being mounted to an inner wall 318 of either fresh food compartment 102 or freezer food compartment 104 of refrigerator 100.

First plate 302 has a base portion 320 mounted to inner wall 318 and a flange portion 324 that extends substantially perpendicular from base portion 320. Flange portion 324 has a first opening 328 therethrough. Second plate 306 has a base portion 330 mounted to inner wall 318 and a flange portion 334 extending substantially perpendicular from base portion 330. Flange portion 334 has a second opening 338 therethrough.

Shaft assembly 314 includes a shaft 340, a motor assembly 344, and a driving nut 348. When first plate 302 and second plate 306 are mounted to inner wall 318, first and second openings 328 and 338 are substantially aligned for receiving shaft 340 of shaft assembly 314. Motor assembly 344 is disposed on top of flange portion 324 of first plate 302. Shaft 340 extends through driving nut 348. Driving nut 348 is coupled to a first sliding member 352 received within a first plate track 356. Moving plate 310 is coupled to driving nut 348 such that rotation of shaft 340 moves moving plate 310 in any direction along an axis 360. Moving plate 310 has second and third sliding members 364 and 366 received within second and third plate tracks 370 and 372, respectively. Second and third plate tracks 370 and 372 are configured to be mounted to refrigerator tracks 380 extending along inner wall 318.

Exemplary embodiments of refrigerator systems are described above in detail. The systems are not limited to the specific embodiments described herein, but rather, components of each assembly may be utilized independently and separately from other components described herein. Each refrigerator component can also be used in combination with other refrigerator and evaporator components. In addition, the above described shelf assembly and shelf is not limited for use in refrigerators, but may be utilized in any application where shelving is desirable.

While the invention has been described in terms of various specific embodiments, those skilled in the art will recognize that the invention can be practiced with modification within the spirit and scope of the claims.

What is claimed is:

1. A shelf assembly comprising:

a plate having a shaft flange extending substantially perpendicular therefrom, said plate comprising a plate track defining a groove;

a shaft mounted to said shaft flange, said shaft extending from said shaft flange along a first axis;

a shelf comprising a first outer edge and a second outer edge, said second outer edge spaced substantially parallel to said first outer edge, said shelf slidably mounted to said shaft such that said shelf is movable on said shaft along said first axis;

a moving plate coupled to said shelf, said moving plate extending between said first outer edge and said second outer edge; and a bracket coupling a first slide member to said moving plate, said first slide member receivable within said groove and slidable within said groove along said first axis.

2. A shelf assembly according to claim 1 further comprising a driving element having an opening, wherein said shaft extends through said opening, and said driving element is mounted to said moving plate.

3. A shelf assembly according to claim 2 wherein said shaft is in a threaded relationship with said opening so that rotating said shaft moves said shelf along said first axis.

4. A shelf assembly according to claim 1 further comprising a motor assembly coupled to said shaft and configured to rotate said shaft.

5. A shelf assembly according to claim 1 wherein said shaft is substantially circular.

6. A shelf assembly according to claim 1 wherein said first slide member is coupled proximate said first outer edge of said shelf, said shelf assembly further comprising a second slide member coupled proximate said second outer edge of said shelf, said first outer edge generally opposed to said second outer edge, said second slide member slidable along said first axis.

7. A refrigerator comprising a fresh food compartment;

a freezer compartment; and a shelf assembly mounted in at least one of said fresh food compartment and freezer compartment, said shelf assembly comprises:

a plate having a shaft flange extending substantially perpendicular therefrom, said plate comprising a plate track defining a groove;

a shaft mounted to said shaft flange, said shaft extending from said shaft flange along a first axis;

a shelf comprising a first outer edge and a second outer edge, said second outer edge spaced substantially parallel to said first outer edge, said shelf slidably mounted to said shaft such that said shelf is movable on said shaft along said first axis;

a moving plate coupled to said shelf, said moving plate extending between said first outer edge and said second outer edge; and a bracket coupling a first slide member to said moving plate, said first slide member receivable within said groove and slidable within said groove along said first axis.

8. A refrigerator according to claim 7 further comprising a driving element having an opening, wherein said shaft extends through said opening, and said driving element is mounted to said moving plate.

9. A refrigerator according to claim 8 wherein said shaft is in a threaded relationship with said opening so that rotating said shaft moves said shelf along said first axis.

10. A refrigerator according to claim 8 further comprises a motor assembly coupled to said shaft and configured to rotate said shaft.

11. A refrigerator according to claim 8 wherein said shaft is substantially circular.

12. A refrigerator according to claim 8 wherein said first slide member is coupled proximate said first outer edge of said shelf, said shelf assembly further comprising a second slide member coupled proximate said second outer edge of said shelf, said first outer edge generally opposed to said second outer edge, said second slide member slidable along said first axis.

* * * * *